United States Patent [19]

Kolleth

[11] Patent Number: 4,729,445

[45] Date of Patent: Mar. 8, 1988

[54] CATERPILLAR CHASSIS FOR HEAVY VEHICLES

[75] Inventor: Horst Kolleth, Zeltweg, Austria

[73] Assignee: Voest-Alpine Aktiengesellschaft, Austria

[21] Appl. No.: 923,644

[22] Filed: Oct. 27, 1986

[30] Foreign Application Priority Data

Oct. 28, 1985 [AT] Austria ..... 3114/85

[51] Int. Cl.[4] ..... B62D 55/00; B62D 11/04

[52] U.S. Cl. ..... 180/9.46; 180/6.58

[58] Field of Search ..... 180/9.46, 9.44, 9.1, 180/6.58, 6.7; 212/195; 414/687

[56] References Cited

U.S. PATENT DOCUMENTS 2,375,265 5/1945 Wagner et al. ..... 180/6.58
3,451,494 6/1969 Kowalik ..... 180/9.44
4,174,757 11/1979 Stedman ..... 180/9.46
4,415,050 11/1983 Nishida et al. ..... 180/6.58

*Primary Examiner*—John J. Love
*Assistant Examiner*—Donn McGiehan
*Attorney, Agent, or Firm*—Cushman, Darby & Cushman

[57] ABSTRACT

The caterpillar chassis (1) for heavy vehicles, such as bucket-wheel excavators or wheeled loaders, has four caterpillars (2, 9) being arranged such that they spread out a supporting triangle (4). The front caterpillars (9), which are located at a smaller distance from the longitudinal axis (3) of the chassis, are designed for being dirigible. The swivel axis (11) of the traversing gear supported on the supporting triangle (4) is displaced out of the position (10) of the center of gravity of the supporting triangle (4) in direction to the front end (8) of the supporting triangle along the height line (7), so that the load acting on the caterpillars (2 and 9) is made more uniform.

4 Claims, 1 Drawing Figure

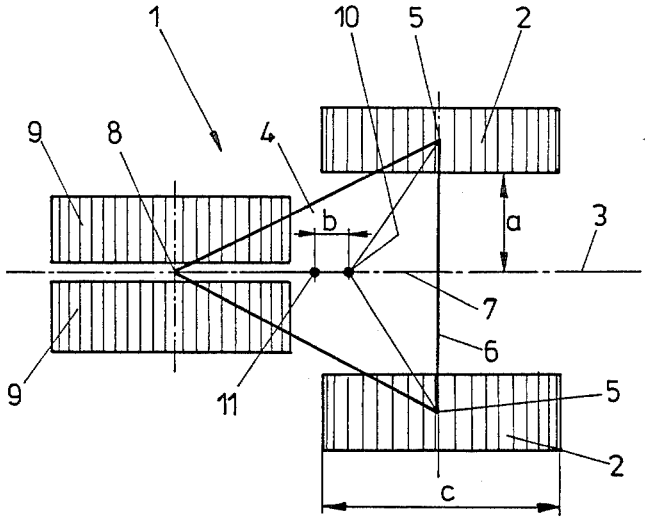
1
10
5
2
9
8
4
b
a
3
7
6
9
11
5
2
c

CATERPILLAR CHASSIS FOR HEAVY VEHICLES

BACKGROUND OF THE INVENTION

1. Field of the Invention

The invention refers to an endless tread chassis for heavy vehicles, such as bucket-wheel excavators or wheeled loaders for example, comprising a rotary table traversing gear for cantilever arms, said chassis comprising at least four endless treads, at least two parallel endless treads of which are located at a greater distance from the longitudinal axis of the vehicle than at least two further treads being staggered in longitudinal direction of the vehicle. Vehicles which include rotary tables carry, as a rule, big cantilever arms which are connected with a base frame for being swingable around a substantially vertical swing axis. The cantilever arms are frequently counterbalanced by counterweight arms to such an extent that the supporting forces to be received by the chassis are received in parallel direction to the swing axis of the cantilever arm and approximately coaxially relative to the swing axis of the cantilever arm.

2. Description of the Prior Art

There is already known a plurality of constructions of endless treads chassis, in which is provided a plurality of endless treads for supporting the forces on ground. By means of such chassis, the supporting forces can be distributed over greater surface areas, so that sinking of the vehicle into ground can be avoided. In addition to vehicles having two endless treads essentially parallely arranged one relative to the other, there are also known vehicles having further endless treads. In case of only two treads, steering of the vehicles is effected by braking or accelerating one of both treads relative to the other. In case of more than two treads can be dirigible treads and be swingably linked to a supporting structure. If there are provided three treads, two treads are, as a rule, arranged in the rear area of the vehicle and in parallel relation one relative to the other and in parallel relation relative to the longitudinal axis of the vehicle, whereas a third tread is designed for being dirigible and is centrally arranged, as seen in longitudinal direction of the vehicle, in front of the not steered treads. In such constructions, the base frame for the rotary table is supported on three points and a supporting triangle is spread out. The swing axis of swivellable cantilever arms supported on such frames has been, as a rule, arranged in the known constructions within the center of gravity of the supporting triangle and thus within the point of intersection of the axes of gravity of the spread-out triangle.

SUMMARY OF THE INVENTION

The invention now aims at providing an endless tread vehicle of the initially mentioned type which can, as compared with usual endless tread vehicle of equal admitted supporting load, make use of chassis of reduced length and or reduced width. For solving this task, the invention essentially consists in that the vertical swing axis of the rotary table for the cantilever arms is displaced out of the center of gravity of the supporting triangle (described in detail hereinafter) in a direction toward that triangular point of the supporting triangle which points in the longitudinal direction of the vehicle. On account of this displacement, force transmission into the treads can, as compared with the usual force transmission, be changed to such a degree, that each individual tread is more uniformely loaded. Simultaneously, the dirigibility of the vehicle is substantially improved and the lateral distance of the treads from each other can be selected smaller, thereby still being in the position to support the same supporting forces as compared with a conventional construction. In a preferred manner, the arrangement is for this purpose such, that two dirigible treads, being dirigible in common, are arranged in closer proximity to the longitudinal axis than two treads being staggered in longitudinal direction of the vehicle and extending in parallel relation to this longitudinal direction of the vehicle. By staggered in longitudinal direction is meant that there are two pairs of side-by-side treads, the pairs lying in different cross-sectional planes. This arrangement provides the advantageous possibility to arrange the swing axis of the rotary table on the supporting triangle such that approximately 50 percent of the supporting force are transmitted into the dirigible treads and approximately 50 percent of the supporting force are distributed over the parallel treads having the greater distance one from the other. While in known constructions comprising three treads, each of these treads had to support one third of the supporting force and for this purpose the swing axis is arranged within the center of gravity of the supporting triangle, the additional fourth tread provides the possibility to swingably arrange two treads at the tip of the supporting triangle and to displace the force introduction subsequently such that the surface force transmitted by each tread on ground is substantially the same. In any case, the arrangement according to the invention, in which the swing axis is displaced in direction to the tip of the supporting triangle, is advantageous for being used in embodiments in which the number of dirigible treads is equal the number of non-dirigible treads.

BRIEF DESCRIPTION OF THE DRAWING

In the following, the invention is further explained with reference to the drawing schematically showing a top plan view of an embodiment of an endless tread vehicle.

DETAILED DESCRIPTION OF THE PREFERRED EMBODIMENT

In the drawing, there can be seen an endless tread vehicle 1 having two rear treads 2. Said both treads 2 have a distance a from the longitudinal axis 3 of the vehicle. The points of attack of the supporting triangle 4 on these rear treads 2 are designated by 5. The connecting line between these points 5 of attack, which connecting line is designated by 6, is normally intersected by the height of the supporting triangle 4, said height being designated by 7. At the front supporting point of the supporting triangle 4, there is arranged a dirigible tread chassis consisting of two treads 9 and being swivellable around an axis 8. The free distance between said both treads 9 is smaller than the free distance 2*a* of the treads 2 one from the other. Dirigibility of these treads is thus substantially improved.

The supporting triangle 4 has a center of gravity 10 being located within the point of intersection of the axes of gravity. One of the axes of gravity is the height 7 of the supporting triangle. The axis of the rotary table is now displaced along this height line 7 for a distance b in direction to the tip 8 of the supporting triangle, the new swing axis being designated by 11. Displacing of the swing axis of the rotary table is thus effected along the longitudinal axis of the vehicle and thus along the height 7 of the supporting triangle 4 in direction to the front pivot point 8 of the dirigible treads 9, noting that this distance b is determined such that the forces introduced into the treads 2 and 9 are the same for each tread. In this manner and in contrast to a triangular support of usual construction, approximately 50 percent of the supporting load are transmitted onto the treads 2 and 50 percent of the supporting load are transmitted onto the dirigible treads 9. On account of this load distribution, the stability is increased to such an extent that the distance *2a* of the non-dirigible treads 2 in the rear area of the vehicle can, as compared with usual constructions, be reduced without any loss of supporting capacity. Simultaneously, the length c of the individual treads can, as compared with usual endless tread vehicle, be reduced without increasing the surface load of individual treads 2 or 9 to an inadmissible extent.

What is claimed is:

1. In an endless tread chassis for a heavy vehicle of the kind which includes a rotary table swingable about a vertical swing axis for carrying a cantilever arm, said chassis having a longitudinal axis lying in a longitudinal vertical plane and having at least four endless treads, the first and second of said treads being parallel and located on opposite sides of said longitudinal axis in a first plane which is transverse to said longitudinal axis and the third and fourth of said treads being parallel and located on opposite sides of said longitudinal axis at greater distances from said longitudinal axis than the first and second treads and in a second plane which is transverse to said longitudinal axis and which is spaced along said longitudinal axis from said first plane, said first and second treads being connected to the chassis at a common first connecting point lying in said longitudinal vertical plane and said third and fourth treads being connected to the chassis at second and third connecting points laterally spaced from said longitudinal vertical plane, said first, second and third connecting points defining the apexes of a supporting triangle and said vertical swing axis being located away from the center of gravity of said supporting triangle in a direction toward said common first connecting point.

2. An endless tread chassis as in claim 1 wherein the first and second treads are dirigible in common.

3. An endless tread chassis as in claim 2 wherein said vertical swing axis is located such that approximately 50% of the supporting forces are distributed over the dirigible treads and approximately 50% of the supporting forces are distributed over the other two treads.

4. An endless tread chassis as in claim 2 wherein the number of dirigible treads is equal to the number of non-dirigible treads.

* * * * *